US006263821B1

(12) United States Patent
Hodder

(10) Patent No.: US 6,263,821 B1
(45) Date of Patent: Jul. 24, 2001

(54) CLEANING MEANS

(76) Inventor: James Nelson Hodder, 302 Waikawa Rd., Picton (NZ)

( * ) Notice: Subject to any disclaimer, the term of this patent is extended or adjusted under 35 U.S.C. 154(b) by 0 days.

(21) Appl. No.: 09/607,784

(22) Filed: Jun. 30, 2000

(30) Foreign Application Priority Data

Jul. 1, 1999 (NZ) ..... 336565

(51) Int. Cl.[7] ..... B63B 59/00
(52) U.S. Cl. ..... 114/222; 15/1.7
(58) Field of Search ..... 114/222; 15/1.7

(56) References Cited

U.S. PATENT DOCUMENTS 3,707,737 * 1/1973 Brower ..... 114/222
4,102,290 7/1978 Weiss ..... 114/222
4,407,213 * 10/1983 Evans ..... 114/222

* cited by examiner

*Primary Examiner*—Jesus D. Sotelo
(74) *Attorney, Agent, or Firm*—Klauber & Jackson

(57) ABSTRACT

According to one form of the invention, and with reference to FIG. 1, there is provided a cleaning means in the form of a boat hull cleaner 1. The boat hull cleaner 1 is used by a person 2 to clean the hull 3 of a boat 4 below a waterline 5. The boat hull cleaner 1 has a telescoping handle 6, a buoyancy control means 7, and a cleaning portion such as a scrubbing brush 8. The buoyancy control means 7 can be filled with water or some other fluid to regulate its buoyancy. When the boat hull cleaner is in use the buoyancy control means 7 serves to encourage the scrubbing brush 8 against the hull 3 to facilitate cleaning of the hull 3.

24 Claims, 5 Drawing Sheets

CLEANING MEANS

FIELD OF THE INVENTION

This invention relates to cleaning means. In particular, a preferred form of the invention relates to a tool for cleaning hulls of water craft or the like.

A problem in the field of water craft is that a layer of slime may form on the hull of a boat or ship below the water line. The presence of slime often leads to crustaceans attaching themselves to the hull, and the weight of the crustaceans can become quite significant over time. Indeed with large ocean going water craft the weight of crustaceans attached to the hull may be several tonnes, and this can undesirably effect the fuel efficiency of the craft. It is accordingly an object of the present invention to go at least some way towards addressing the above problem.

BRIEF SUMMARY OF THE INVENTION

According to one form of the invention there is provided cleaning means, having buoyancy control means, handle means, and a cleaning portion, the cleaning means being formed such that when it is in use a person can be positioned adjacent a water craft above a waterline and move the handle means such that movement of the handle means causes the cleaning portion to move across a hull of the water craft below the waterline to substantially clean the hull while the buoyancy control means remains below the waterline and encourages the cleaning portion against the hull, or prevents the cleaning portion from sinking below the hull, to facilitate cleaning of the hull, the buoyancy control means having a container which can be at least partially filled with water or some other liquid to regulate buoyancy of the buoyancy control means.

Optionally, the buoyancy control means may be of a substantially hexagonal or of a substantially octagonal shape.

Preferably the container has an opening and a lid, wherein the lid can be moved directly by hand such that the water or other liquid can be at least partially filled into the container and the lid then moved again to close the container.

Preferably the lid can be screwed onto the rest of the container to close the container.

Preferably the handle means has a joint or joints which enable the handle means to at least partially fold.

Preferably the handle means has a substantially rod shaped handle.

Preferably the cleaning portion has a scrubbing brush, and/or a scourer, and/or a squeegee.

Preferably the buoyancy control means has a channel and an outlet for a jet of water such that the jet of water can emerge from the buoyancy control means to contact the hull of the water craft below the waterline to facilitate cleaning of the hull.

Preferably the cleaning means has a fitting for holding a hose pipe or a hose pipe nozzle adjacent the buoyancy control means such that the hose pipe or hose pipe nozzle can direct a jet of water to contact the hull of the water craft below the waterline to facilitate cleaning of the hull.

Preferably the cleaning portion and the handle are detachable from the buoyancy control means.

Preferably the cleaning means has an outwards projection arranged to resist hooking of the buoyancy control means on the hull.

According to another form of the invention there is provided a method of cleaning, involving obtaining a cleaning means as mentioned above, at least partially filling the container with water or some other fluid to give the buoyancy control means a desired buoyancy, submerging the container and the cleaning portion below a waterline and manipulating the handle means from above the waterline so that the cleaning portion moves across a hull of a water craft below the waterline to substantially clean the hull while the container remains below the waterline and encourages the cleaning portion against the hull, or prevents the cleaning portion from sinking below the hull, to facilitate cleaning of the hull.

Some preferred forms of the invention will now be described by way of example, and with reference to the accompanying drawings.

DETAILED DESCRIPTION

Figure 1:
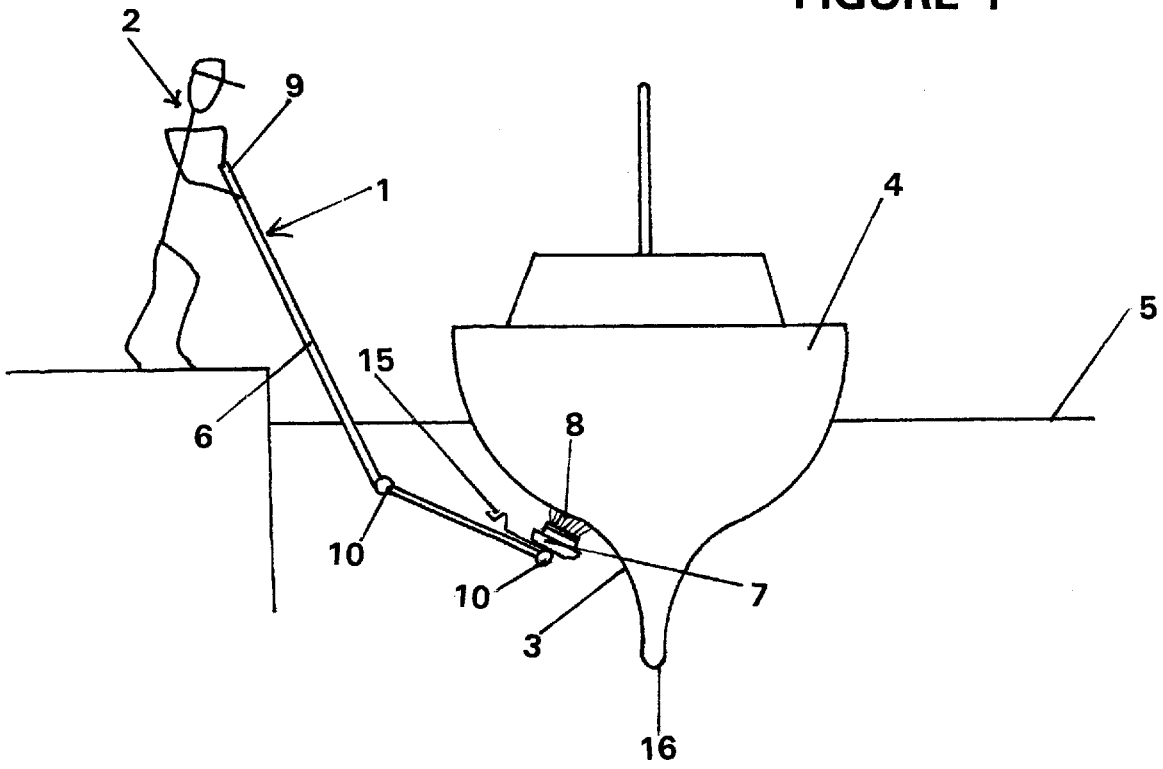
FIG. 1 shows a hull cleaner being used to clean the hull of a boat.

With reference to FIG. 1, the hull cleaner 1 can be used by a person 2 to clean or polish the hull 3 of a boat 4 below a waterline 5. The hull cleaner 1 has handle means in the form of a rod shaped telescoping handle 6, buoyancy control means 7, and a cleaning portion in the form of a scrubbing brush 8. The person 2 can grip one end 9 of the handle 6 and manipulate the handle 6 to cause the brush 8 to clean the hull 3 below the water line 5. This cleaning action may remove slime and/or crustaceans attached to the hull 3. The buoyancy control means 7 acts to encourage the brush 8 against the hull 3, and prevents the brush 8 from sinking to an undesirable level below the waterline 5.

Figure 2:
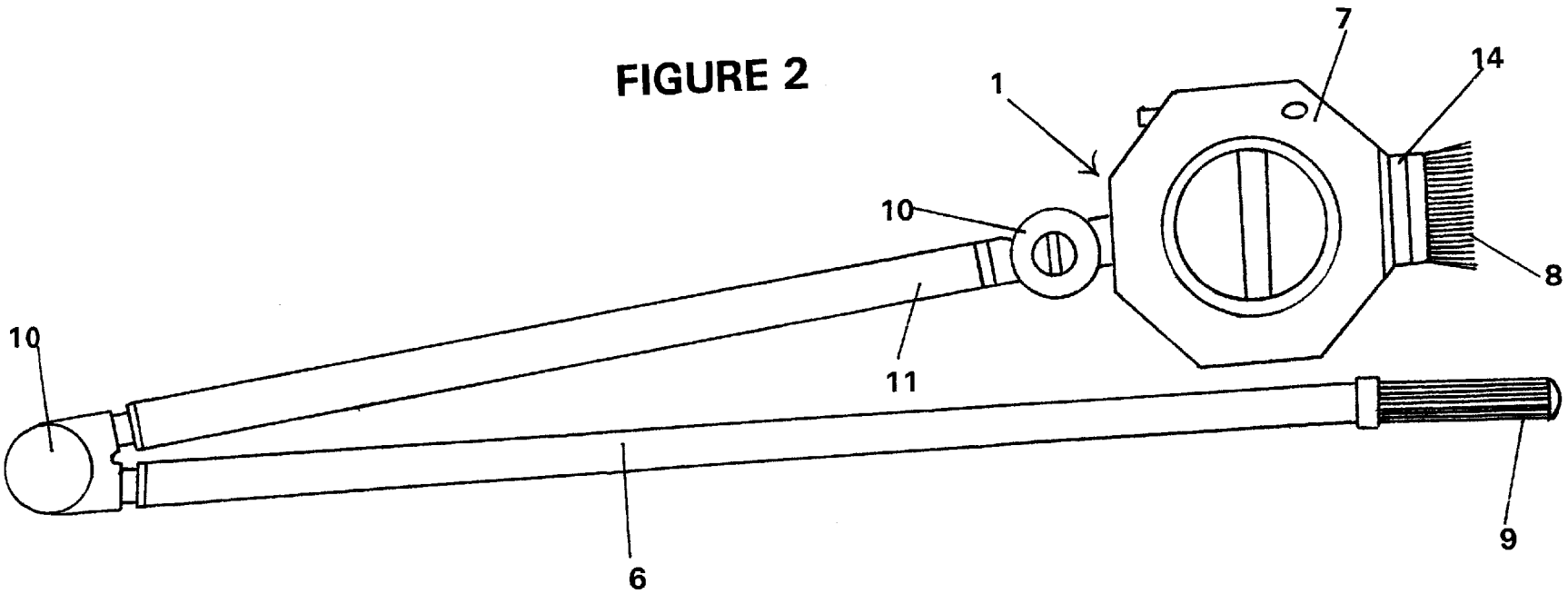
FIG. 2 is a plan view of the hull cleaner.

With reference to FIG. 2, the handle 6 has knuckle joints 10 which enable the handle 6 to fold. This ability to fold enables the handle 6 to assume a more compact form for storage, and also enables the person 2 to angle the handle 6 and buoyancy control means 7 to more effectively contact the hull 3. The hull cleaner is formed so that an end 11 of the handle 6 is screw fitted into the buoyancy control means 7, and can be removed therefrom when desired. The brush 8 is also screw fitted to the buoyancy control means 7, and can be removed for replacement when desired.

Figure 3:
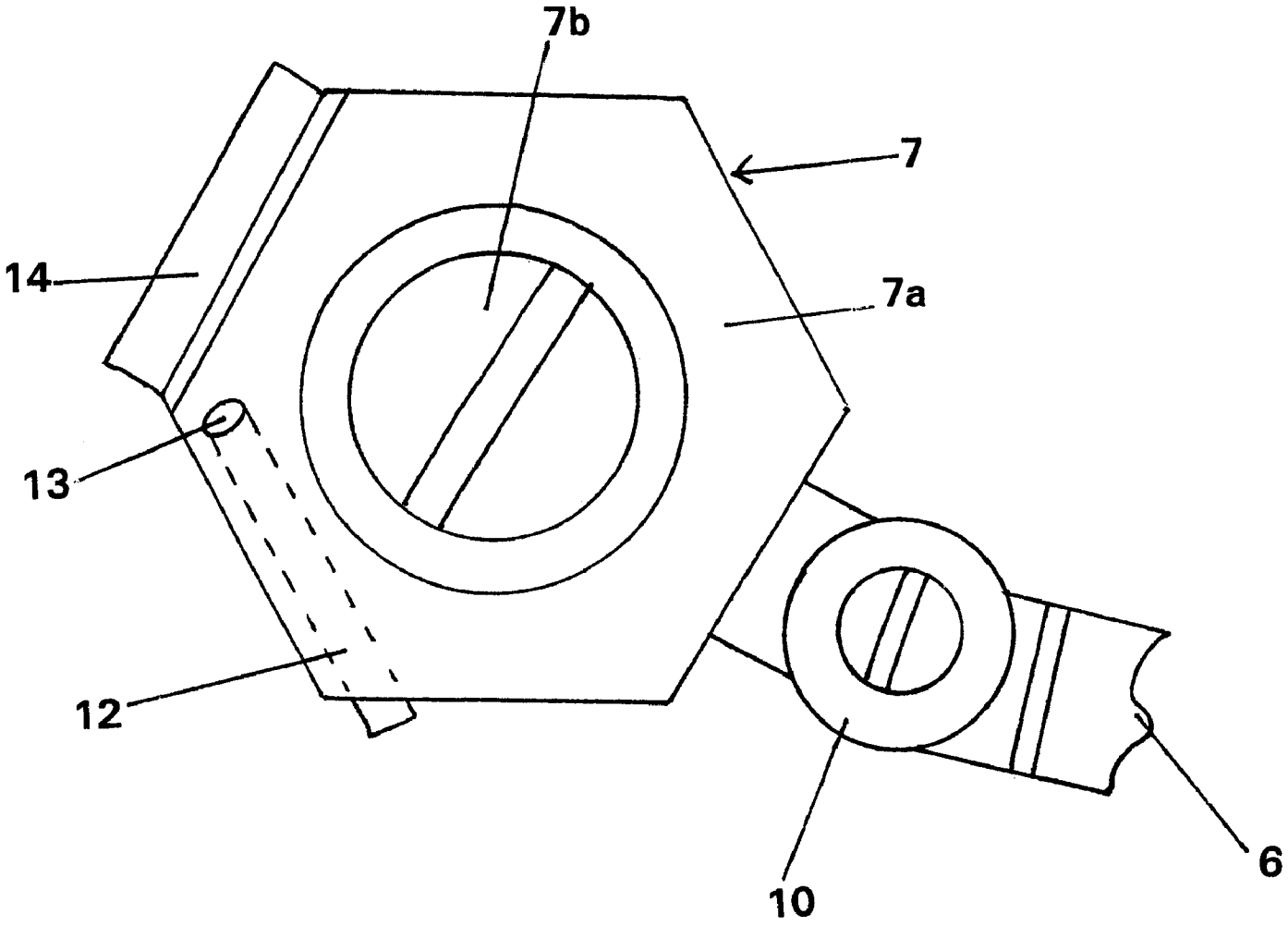
FIG. 3 is a plan view of a buoyancy control means forming part of the hull cleaner.
Figure 4:
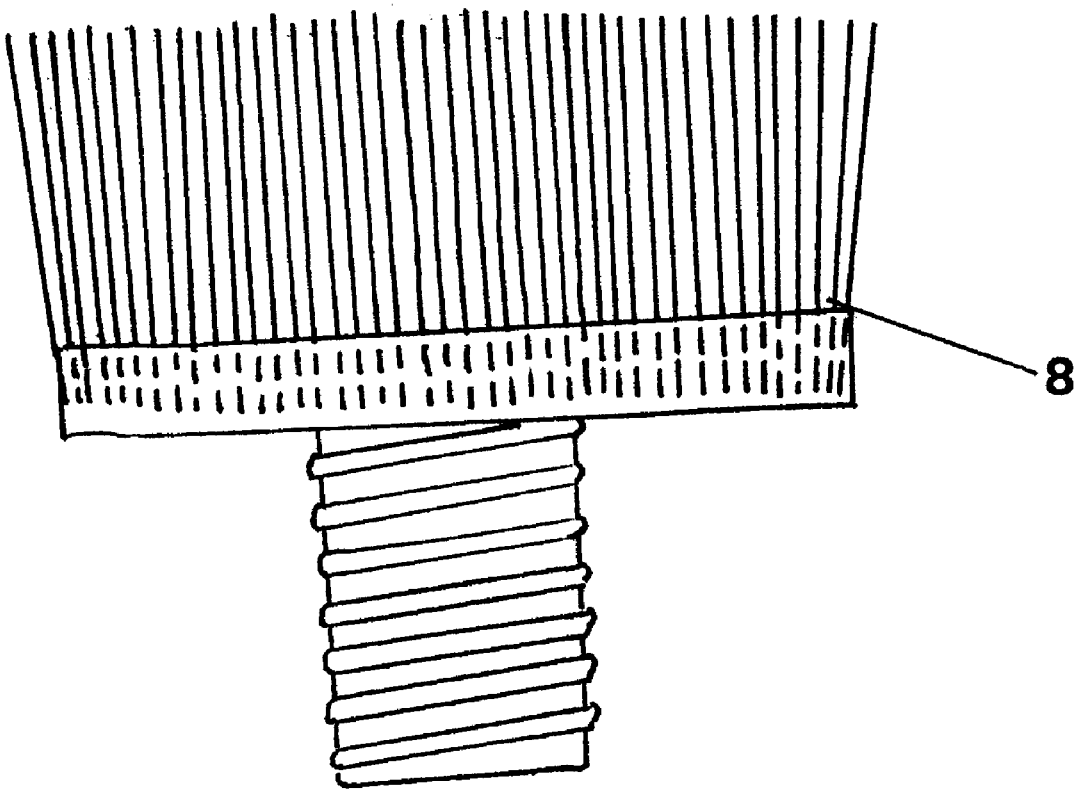
FIG. 4 shows a scrubber brush which forms part of the hull cleaner.

Referring to FIG. 3, the buoyancy control means 7 has an internal channel 12 and an outlet 13. A hose including a pipe and nozzel can be attached to the hull cleaner 1 so that it carries a jet of water into the channel 12 such that the jet exits via the outlet 13. The jet of water can be used to assist in cleaning the hull 3. In some embodiments of the invention the buoyancy control means 7 may simply have a fitting for holding a hose pipe nozzle adjacent the buoyancy control means 7. With further reference to FIG. 3, there is shown a head 14 for forming part of the brush 8, or for forming part of a scourer (not shown). Optionally a squeegee can be used in place of a brush or scourer.

As shown in FIG. 3, the buoyancy control means 7 has a container body 7*a* and a screw-on lid 7*b*. The lid 7*b* can be removed, the container body 7*a* filled to a desired level with water or some other material, and the lid 7*b* then put back in place. The amount of water or other material in the container body 7*a* determines the buoyancy of the buoyancy control means 7. Those skilled in the art will appreciate that the amount of water or other material in the container body 7*a* also determines the buoyancy pressure acting to encourage the brush 8, the scourer, or the squeegee, against the hull 3. Without anything inside the container body 7*a* the buoyancy control means 7 tends towards the water level 5

Figure 5:
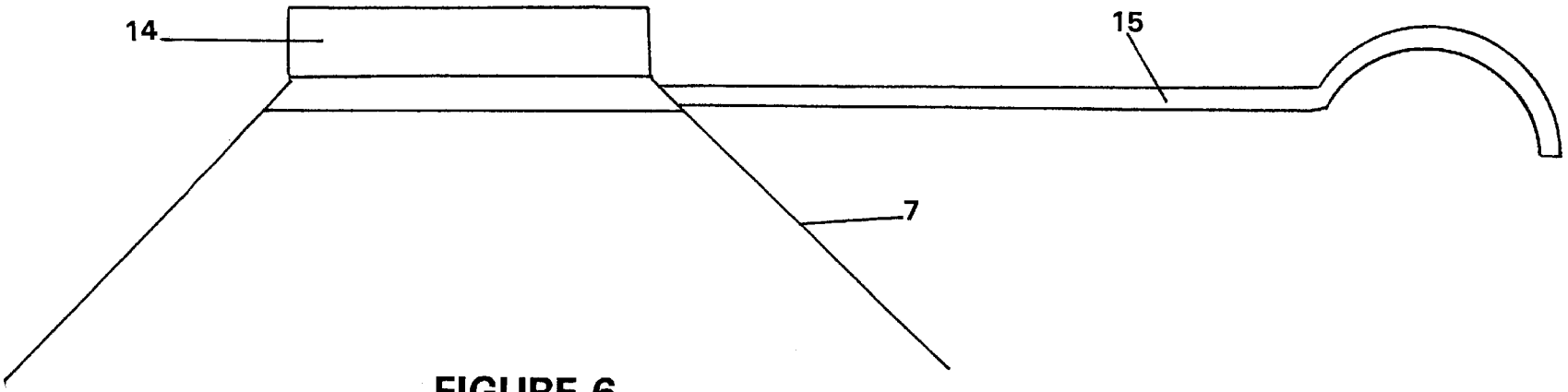
FIGS. 5 & 6 show an over rider which also forms part of the hull cleaner.
Figure 6:
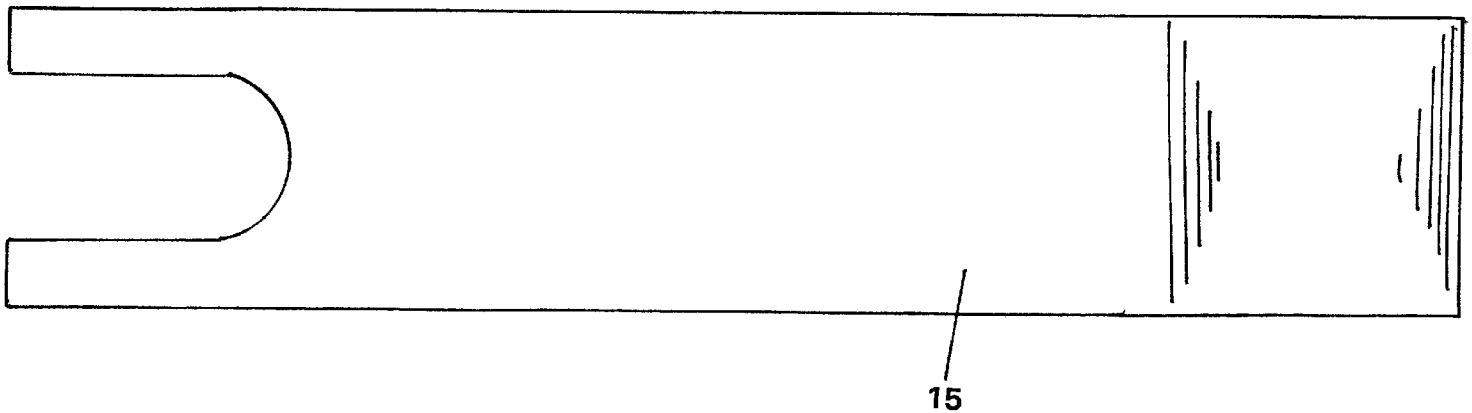

With reference to FIGS. 1, 5 and 6, the buoyancy control means 7 can be fitted with an over rider 15. The over rider 15 serves to prevent the hull cleaner 1 from becoming hooked against the lowermost part or apex of the hull 3 in the event that the buoyancy control means 7 is pushed beyond the lowermost part or apex of the hull 3. The lowermost part or apex is indicated at FIG. 1 by the reference number 1 6.

While some preferred forms of the invention have been described by way of example, it should appreciated that modifications and improvements can occur without departing from the scope of the appended claims.

I claim:

1.Cleaning means, having buoyancy control means, handle means, and a cleaning portion, the cleaning means being formed such that when it is in use a person can be positioned adjacent a water craft above a waterline and move the handle means such that movement of the handle means causes the cleaning portion to move across a hull of the water craft below the waterline to substantially clean the hull while the buoyancy control means remains below the waterline and encourages the cleaning portion against the hull, or prevents the cleaning portion from sinking below the hull, to facilitate cleaning of the hull, the buoyancy control means having a container which can be at least partially filled with water or some other liquid to regulate buoyancy of the buoyancy control means, the buoyancy control means having a channel and an outlet for direction a jet of water such that the jet of water can emerge from the buoyancy control means to contact the hull of the water craft below the waterline to facilitate cleaning of the hull.

2. Cleaning means according to claim 1, wherein the container has an opening and a lid, wherein the lid can be moved directly by hand such that the water or other liquid can be at least partially filled into the container and the lid then moved again to close the container.

3. Cleaning means according to claim 2, wherein the lid can be screwed onto the rest of the container to close the container.

4. Cleaning means according to claim 1, wherein the handle means has joint means which enables the handle means to at least partially fold.

5. Cleaning means according to claim 1, wherein the handle means has a substantially rod shaped handle.

6. Cleaning means according to claim 1, wherein the cleaning portion has a scrubbing brush.

7. Cleaning means according to claim 1, wherein the cleaning portion has a scourer.

8. Cleaning means according to claim 1, wherein the cleaning portion has a squeegee.

9. Cleaning means according to claim 1, wherein the cleaning portion and the handle means are detachable from the buoyancy control means.

10. Cleaning means according to claim 1, having an outwards projection arranged to resist hooking of the buoyancy control means on the hull.

11.Cleaning means according to claim 1, wherein the buoyancy control means is a substantially octagonal shape.

12. Cleaning means according to claim 1, wherein the buoyancy control means is a substantially hexagonal shape.

13. Cleaning means having buoyancy control means, handle means, and a cleaning portion, the cleaning means being formed such that when it is in use a person can be positioned adjacent a water craft above a waterline and move the handle means such that movement of the handle means causes the cleaning portion to move across a hull of the water craft below the waterline to substantially clean the hull while the buoyancy control means remains below the waterline and encourages the cleaning portion against the hull, or prevents the cleaning portion from sinking below the hull, to facilitate cleaning of the hull, the buoyancy control means having a container which can be at least partially filled with water or some other liquid to regulate buoyancy of the buoyancy control means, the cleaning means having a fitting for holding at least part of a hose adjacent the buoyancy control means such that the at least part of the hose can direct a jet of water to contact the hull of the water craft below the waterline to facilitate cleaning of the hull.

14. Cleaning means according to claim 13, wherein the container has an opening and a lid, wherein the lid can be moved directly by hand such that the water or other liquid can be at least partially filled into the container and the lid then moved again to close the container.

15. Cleaning means according to claim 13, wherein the lid can be screwed onto the rest of the container to close the container.

16. Cleaning means according to claim 13, wherein the handle means has joint means which enables the handle means to at least partially fold.

17. Cleaning means according to claim 13, wherein the handle means has a substantially rod shaped handle.

18. Cleaning means according to claim 13, wherein the cleaning portion has a scrubbing brush.

19. Cleaning means according to claim 13, wherein the cleaning portion has a scourer.

20. Cleaning means according to claim 13, wherein the cleaning portion has a squeegee.

21. Cleaning means according to claim 13, herein the cleaning portion and the handle means are detachable from the buoyancy control means.

22. Cleaning means according to claim 13, having an outwards projection arranged to resist hooking of the buoyancy control means on the hull.

23. Cleaning means according to claim 13, wherein the buoyancy control means is a substantially octagonal shape.

24. Cleaning means according to claim 16, wherein the buoyancy control means is a substantially hexagonal shape.

* * * * *